United States Patent [19]

Netten et al.

[11] Patent Number: 4,808,877

[45] Date of Patent: Feb. 28, 1989

[54] LOW-PRESSURE SODIUM DISCHARGE LAMP HAVING A COLLAR-LIKE HEAT SHIELD

[75] Inventors: Adriaan Netten; Karel R. Vervecken, both of Eindhoven, Netherlands

[73] Assignee: U.S. Philips Corporation, New York, N.Y.

[21] Appl. No.: 104,541

[22] Filed: Sep. 29, 1987

Related U.S. Application Data

[63] Continuation of Ser. No. 821,108, Jan. 21, 1986.

[30] Foreign Application Priority Data

Feb. 15, 1985 [NL] Netherlands ..... 8500432

[51] Int. Cl.[4] ..... H01J 61/34; H01J 61/52

[52] U.S. Cl. ..... 313/25; 313/43; 313/492

[58] Field of Search ..... 313/25, 493, 492, 43, 313/634, 623, 609, 611, 612

[56] References Cited

U.S. PATENT DOCUMENTS

| | | | |
|---|---|---|---|
| 2,267,090 | 12/1941 | Freeman | 313/254 |
| 2,562,887 | 8/1951 | Beese | 313/25 X |
| 4,129,800 | 12/1978 | Van Benthem et al. | 313/25 |
| 4,536,678 | 8/1985 | Bouchard et al. | 313/493 |
| 4,588,919 | 5/1986 | Kroontje et al. | 313/25 |
| 4,600,856 | 7/1986 | Bouchard et al. | 313/493 X |
| 4,636,691 | 1/1987 | de Man | 315/209 R |

FOREIGN PATENT DOCUMENTS 6411552 11/1965 Netherlands .

*Primary Examiner*—David K. Moore
*Assistant Examiner*—K. Wieder
*Attorney, Agent, or Firm*—Brian J. Wieghaus

[57] ABSTRACT

The low-pressure sodium discharge lamp according to the invention has a U-shaped discharge tube (1) with seals (4, 5), through which current-supply conductors (6, 7) extend to electrodes (8, 9). A supporting member (14) fixes the discharge tube (1) in an outer bulb (10). Upright collars (18, 19) at the supporting member (14), which surround the seals (4, 5) throughout their lengths, prevent the discharge tube from becoming leaky at high-frequency operation and the lamp from reaching the end of its life prematurely.

12 Claims, 1 Drawing Sheet

LOW-PRESSURE SODIUM DISCHARGE LAMP HAVING A COLLAR-LIKE HEAT SHIELD

This is a continuation of application Ser. No. 821,108 filed Jan. 21, 1986.

The invention relates to a low-pressure sodium discharge lamp comprising a U-shaped gas-tight discharge tube having seals at its free ends and a sodium-containing gas filling;

electrodes which are arranged in this tube near these ends;

a gas-tight outer bulb or envelope which is arranged to surround the discharge tube and having a lamp cap;

current-supply conductors are extended through the seals and electrically connect each electrode to the lamp cap;

a supporting member for the discharge tube comprising a disk-shaped portion having an opening through which the seals of the discharge tube are passed, and having tongues bearing on the wall of the outer bulb. Such a tube is known from Netherlands Patent Application No. 6411552.

It is known that low-pressure sodium discharge lamps during operation at an alternating voltage of several tens to several hundreds of kHz have a higher efficiency than in the case of operation at 50 or 60 Hz (British Patent Application No. 2,134,701 to which U.S. patent application Ser. No. 4,636,691 filed Dec. 16, 1983 corresponds.

However, it has been found that with high-frequency operation the known lamp has a shorter life due to the fact that the discharge vessel becomes leaky apparently as a result of factors caused by high frequency operation.

The invention has for its object to render the lamp of the kind described in the opening paragraph more resistant to vessel leakage effects caused by high-frequency operation by a very simple constructional modification.

According to the invention, this object is achieved in that each of the seals is received at least substantially throughout its length by an upright collar-like heat shield at the supporting member.

The measure taken in the lamp according to the invention results in that the life of the lamp is considerably lengthened, although the measure implies only a very simple constructional modification in the known lamp. A strip of a material, for example stainless steel, having a width corresponding to the length of the seals of the discharge tube is arranged around the area at which these seals are passed through the disk-shaped part of the supporting member. It may be fixed on the disk-shaped part by solder, glue or in a favourable embodiment weld connections. However, it is alternatively possible for the collar-like heat shield to have a flanged edge or rim which is enclosed between the disk-shaped part of the supporting member and the free ends of the discharge tube.

In lamps according to the invention the seals of the lamp vessel are less susceptible to loss of heat and condensation of sodium at the free ends of the discharge tube is effectively suppressed. It is assumed that the deposition of sodium resulted in the discharge tube becoming leaky.

In an embodiment, the supporting member has two upright collar-like heat shields, each of which receives a respective seal. In a variation of this embodiment, the collar-like heat shields have a U-shaped cross-section and are arranged so that the bases of the U's are located nearest the wall of the outer bulb and hence so that the openings of the U's face each other.

An embodiment of the lamp according to the invention will now be described, by way of example, with reference to the accompanying drawing. In the drawing.

Figure 1:
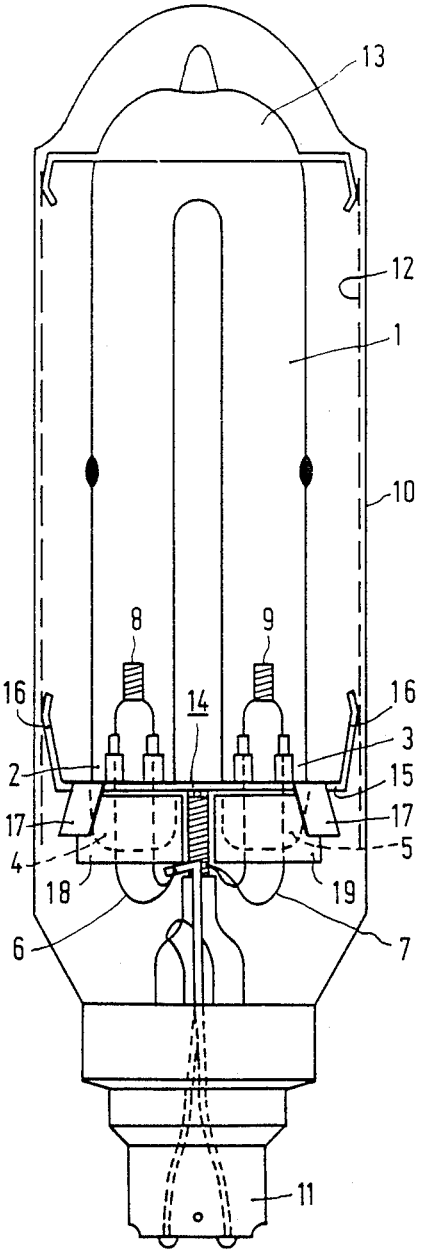
FIG. 1 is a side view of a low-pressure sodium discharge lamp.

In FIG. 1, the lamp has a discharge tube 1 which is U-shaped and has seals 4, 5 respectively at its free ends 2, 3. Electrodes 8, 9 are arranged in tube 1 near its ends 2, 3. A gas-tight outer bulb or envelope 10, surrounds the discharge tube 1 and has attached a lamp cap 11. The outer bulb 10 has on its inner surface a translucent coating 12 reflecting infrared radiation. A hood 13 and a supporting member 14 support the discharge tube 1. The supporting member 14 has a disk-shaped portion 15, through which the seals 4, 5 of the discharge tube 1 are passed, and, and also has tongues 16, 17 bearing on the wall of the outer bulb 10. The seals 4, 5 are received throughout their length by a respective upright collar-like heat shield 18, 19 at the supporting member 14.

The length of the discharge path of the lamp is about 125 mm. The inner diameter of the discharge tube current-supply conductors 6, 7 are extended through seals 4, 5 and electrically connect each electrode 8, 9 to the cap 11. is chosen between 7 and 10 mm and is 8.5 mm in the lamp shown in FIG. 1, which has proved to be very favorable. The lamp contains sodium and Ne/Ar (99/1 vol/vol) up to a pressure of 2.27 kPa. The lamp consumes a power of 5.8 W when operated at 200 kHz.

Figure 2:
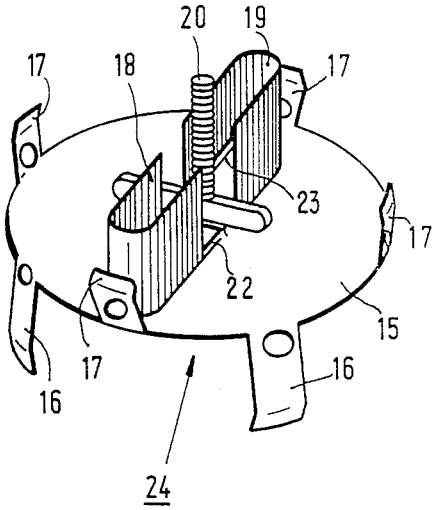
FIG. 2 is a perspective view of a supporting member which corresponds to supporting member 14 as shown in FIG. 1.

In FIG. 2, the portions of the supporting member 24 corresponding to portions of the supporting member 14 of FIG. 1 are denoted by the same reference numberals. In FIG. 2 collar-like heat shields 18 and 19 are U-shaped and are arranged so that the openings of the U-shaped portions face each other. They are made of strips of metal, which, after having been bent into the shape of a U, are welded to the outer surfaces of rims 22, 23 formed at the edges of the openings in the disk-shaped portion 15. This causes the heat shield to be spread from the seals radially a distance at least equal to the thickness of the rim, so that the heat shields reduce heat loss leaking from the seals. Reference numberal 20 designates a helix fixing the supporting member 24 in the axial direction of the outer bulb 10 in FIG. 1.

Lamps having a construction similar to that shown in FIG. 1, which during operation consumed a power of 25 W, were compared with identical lamps, in which the collar-like heat shields 18, 19 at the supporting member were absent. Both series of lamps were tested with respect to the life of the lamps respectively operated at an alternating voltage of 120 kHz. The results of this test are:

Lamps with collar-like heat shields have an average life span of more than 12,500 operating hours.

Lamps without collar-like heat shields, in comparison, have an average life span of only 3500 operating hours.

The life of a lamp according to the invention has a significantly lengthened life span in comparison to lamps of the prior art.

Similar results were obtained with lamps consuming 35 W.

What is claimed is:

1. A low-pressure sodium discharge lamp comprising:

a U-shaped gas-tight discharge tube having seals at its free ends and a sodium-containing filling, electrodes arranged in the discharge tube near the free ends between which a discharge is maintained during lamp operation;

a gas-tight outer bulb which is arranged to surround the discharge tube and having a lamp cap;

current-supply conductors extending through the seals and electrically connecting each electrode to the lamp cap; and a support for the discharge tube comprising a disc-shaped portion having openings through which the seals of the discharge tube extend, and means for fixing the support within the outer bulb, said support comprising at least one collar-like heat shield at least partially surrounding one of said seals for reducing heat loss from said one seal, said heat shield being spaced from said one seal and extending for substantially the length of said one seal.

2. A low-pressure discharge lamp as claimed in claim 1, wherein said support comprises two of said collar-like heat shields, each of which partially surrounds and is spaced from a respective seal.

3. A low-pressure discharge lamp as claimed in claim 1, wherein each of the collar-like heat shields has a U-shaped cross-section with an open end, and said shields are arranged so that the open ends face each other.

4. A low-pressure sodium discharge lamp comprising:

a U-shaped gas-tight discharge tube having seals at its free ends and a sodium-containing filling, electrodes arranged in the discharge tube near the free ends between which a discharge is maintained during lamp operation;

a gas-tight outer bulb which is arranged to surround the discharge tube and having a lamp cap;

current-supply conductors extending through the seals and electrically connecting each electrode to the lamp cap; and a support for the discharge tube comprising a disk-shaped portion having openings through which the seals of the discharge tube extend, and means for fixing the support within the outer bulb, said support comprising a rim having an outer surface formed at the edge of one of said openings and a collar-like heat shield at least partially surrounding that one of said seals passed through said one opening, said heat shield extending for substantially the length of said one seal and being fixed on the outer surfaces of said rim such that said heat shield is spaced a distance radially from said one seal at least equal to the thickness of said rim for reducing heat loss from said one seal.

5. A low-pressure discharge lamp as claimed in claim 4, wherein said support member comprises two said rims and two said collar-like heat shields, each of said heat shields being fixed on the outer surfaces of a respective rim.

6. A low-pressure discharge lamp as claimed in claim 5, wherein each of the collar-like heat shields has a U-shaped cross-section with an open end, and said shields are arranged so that the open ends face each other.

7. A low-pressure sodium discharge lamp, comprising:

(a) an outer envelope;

(b) a low-pressure discharge device within said outer envelope having a sodium-containing gas filling and seals at its free ends, and a pair of electrodes each being arranged proximate a respective seal;

(c) current-supply conductors which extend through said seals and are connected to a respective electrode; and (d) means for supporting said discharge device within said outer envelope, a portion of said support means at least partially surrounding each said seal and extending substantially along the length of each said seal, said portion being free of contact with said seals and being effective as a heat shield to reduce the heat loss from said seals so that the normal operating temperature of said seals is increased and the condensation of sodium proximate said seals is suppressed.

8. A lamp as claimed in claim 7 wherein said portion of said support means comprises a collar-like heat shield attached to said support means.

9. A lamp as claimed in claim 6, wherein said support and said collar-like heat shields are metallic, and said heat shields are welded to a respective rim.

10. A lamp as claimed in claim 9, wherein said means for fixing said support to said outer bulb comprises a plurality of resilient tongues bearing against said outer bulb.

11. A low-pressure sodium discharge lamp, comprising:

a discharge device sealed in a gas tight manner, having a sodium containing filling, and comprising a pair of parallel straight sections having adjacent sealed ends, electrodes arranged in said straight sections proximate said sealed ends, and current-supply conductors each connected to a respective electrode;

an outer envelope having a lamp cap within which said discharge device is arranged, each of said current-supply conductors being connected to a respective portion of said lamp cap;

a metallic support for supporting the discharge tube comprising a planar portion having an opening through which said sealed ends extend, said planar portion being transverse to said straight sections and axially positioned between said sealed ends and said electrodes such that said sealed ends and the major part of said straight sections lie on opposite sides of said planar portion, and a plurality of resilient tongues bearing against said outer envelope for fixing said support with respect to said outer envelope; and a pair of metallic collar-like shields attached to said support for reducing the heat loss from a respective seal so that the normal operating temperature of said seals is increased and the condensation of sodium proximate said seals is suppressed, each heat shield extending from said support in the direction of said seals away from straight sections and having a U-shaped cross-section with an open end, each heat shield at least partially surrounding its respective seal and extending for substantially the length of its respective seal, and said heat-shields being arranged with said open ends facing each other.

12. A lamp as claimed in claim 11, wherein said heat shields are welded to said support.

* * * * *